US009901143B2

(12) United States Patent
Krasney

(10) Patent No.: US 9,901,143 B2
(45) Date of Patent: Feb. 27, 2018

(54) MAGNETIC NECKTIE RETAINER

(71) Applicant: Robert Krasney, Highland, CA (US)

(72) Inventor: Robert Krasney, Highland, CA (US)

( * ) Notice: Subject to any disclaimer, the term of this patent is extended or adjusted under 35 U.S.C. 154(b) by 0 days.

(21) Appl. No.: 15/074,239

(22) Filed: Mar. 18, 2016

(65) Prior Publication Data

US 2016/0309852 A1 Oct. 27, 2016

Related U.S. Application Data

(60) Provisional application No. 62/150,952, filed on Apr. 22, 2015.

(51) Int. Cl.
*A44B 6/00* (2006.01)
*A41F 1/00* (2006.01)

(52) U.S. Cl.
CPC ..... *A44B 6/00* (2013.01); *A44D 2203/00* (2013.01); *Y10T 24/1959* (2015.01)

(58) Field of Classification Search
CPC . Y10T 24/1959; A44D 2203/00; A41F 1/002; A44B 6/00; A44B 9/08
See application file for complete search history.

(56) References Cited

U.S. PATENT DOCUMENTS

| | | | | |
|---|---|---|---|---|
| 2,592,395 | A | 4/1952 | Cummings | |
| 2,601,424 | A | 6/1952 | Baker | |
| 6,971,147 | B2 * | 12/2005 | Halstead | A45C 1/06 24/303 |
| 7,373,696 | B2 * | 5/2008 | Schoening | A41D 25/003 24/303 |
| 8,713,762 | B2 | 5/2014 | Bates | |
| 2006/0265841 | A1 * | 11/2006 | Abadi | A41F 1/002 24/303 |
| 2010/0115734 | A1 | 5/2010 | Wilson | |
| 2012/0324678 | A1 | 12/2012 | Dronia | |

* cited by examiner

*Primary Examiner* — Robert J Sandy
(74) *Attorney, Agent, or Firm* — Global Intellectual Property Agency, LLC; Daniel Enea

(57) ABSTRACT

A magnetic necktie retainer device is provided that retains a necktie to the shirt of a wearer without piercing or otherwise damaging the shirt. The device comprises a front backing plate and a rear backing plate. The backing plates are magnetically attracted to each other such that the rear backing plate is positioned under the wearer's shirt, while the front backing plate is positioned between the necktie and the outside of the wearer's shirt. The two backing plates magnetically secure together, while a necktie retainer article extends from the front backing plate to engage the necktie. The retainer article may comprise a clasp, a chain, a necktie bar, or similar structure that secures the necktie to the front backing plate.

9 Claims, 3 Drawing Sheets

MAGNETIC NECKTIE RETAINER

CROSS REFERENCE TO RELATED APPLICATION

This application claims the benefit of U.S. Provisional Application No. 62/150,952 filed on Apr. 22, 2015. The above identified patent application is herein incorporated by reference in its entirety to provide continuity of disclosure.

BACKGROUND OF THE INVENTION

Field of the Invention

The present invention relates to neckties and garment accessories. More specifically, the present invention relates to a necktie retainer device that utilizes a pair of magnetic backing plates and necktie retainer article to maintain a necktie against the user's shirt.

Neckties are garment items that generally worn with dress shirts, and provide a means to accessorize and add color to a shirt. Anyone who has worn a necktie knows that these items can move around quite a bit while being worn, as they are suspended from the wearer's neck and generally are unsupported otherwise. A slight breeze or sudden movement can cause the tie to lift, flutter, or otherwise move from its central position on the wearer.

Conventional methods for securing a necktie to a wearer include tie tacks and clasps. However, tie tacks pierce the tie and shirt, causing the tie to fray and eventually require replacement or repair of the tie. Clasps, on the other hand, maintain the two ends of a tie together, but are not suited for securing the tie to the wearer's shirt. Therefore, the present invention provides a means that secures the two ends of a tie together, while also securing the tie to the shirt of the wearer. Additionally, the present invention secures a necktie without piercing or otherwise damaging the wearer's shirt in the process.

In particular, the present invention provides a magnetic necktie retainer device. The device provides utility in the form of retaining the wearer's necktie against the wearer's shirt, while also offering a fashionable accessory, depending on design. The device comprises a pair of backing plates with magnets thereon. A rear backing plate is positioned under a wearer's shirt, while a front backing plate is positioned between the wearer's shirt and the backside of the wearer's necktie. Extending from the front backing plate is a necktie retainer article that wraps around the necktie. Overall, the present invention maintains a necktie in place and provides a fashionable accompaniment to any tie and dress shirt ensemble.

SUMMARY OF THE INVENTION

The following summary is intended solely for the benefit of the reader and is not intended to be limiting in any way. The present invention provides a new necktie retainer device that can be utilized for securing a necktie to a wearer's shirt and for providing a fashionable accessory item to accompany an ensemble.

It is therefore an object of the present invention to provide a new and improved necktie retainer device that has all of the advantages of the prior art and none of the disadvantages.

It is another object of the present invention to provide a necktie retainer device that comprises a front backing plate and a rear backing plate that are magnetically attracted to one another and are used to secure a necktie to the shirt of the wearer.

Another object of the present invention is to provide a necktie retainer device, whereby the front and rear backing plates have at least one magnetic attachment therebetween. In some embodiments, both backing plates have magnets that are attracted to one another. In other embodiments, one backing plate has a magnet, and the other backing plate has a ferromagnetic material thereon.

Another object of the present invention is to provide a necktie retainer device, whereby the front backing plate further comprises a necktie retainer article thereon. The necktie retainer article is adapted to secure two segments of a necktie together and retain the two segments against the front backing plate.

Another object of the present invention is to provide a necktie retainer device, whereby the one or more magnets between the backing plates include a magnetic field of sufficient magnitude to secure the rear backing plate to the front backing plate with a dress shirt material layer therebetween.

Another object of the present invention is to provide a necktie retainer device, whereby the front backing plate and the rear backing plate each further comprise planar surfaces.

Another object of the present invention is to provide a necktie retainer device, whereby the least one magnet of the rear backing plate further comprises two magnets and the least one magnet of the front backing plate further comprises two magnets. The two magnets of the front backing plate are aligned with the two magnets of the rear backing plate when the front backing plate is aligned with the rear backing plate.

Another object of the present invention is to provide a necktie retainer device, whereby the necktie retainer article further comprises a necktie chain. The chain has a first end connected to a first end of the front backing plate, and a second end connected to a second end of the front backing plate. The chain and the front backing plate form an enclosed loop adapted to receive a necktie therethrough.

Another object of the present invention is to provide a necktie retainer device, whereby the necktie retainer article further comprises a necktie bar. The necktie bar has a first end connected to a first end of the front backing plate and a second end that is separated from a second end of the front backing plate to form a gap therebetween. The necktie bar and the front backing plate form a partially enclosed interior adapted to retain a necktie therein and receive the necktie through the gap between the second end of the necktie bar and the second end of the front backing plate.

Another object of the present invention is to provide a necktie retainer device, whereby the necktie retainer article further comprises a necktie pin adapted to pierce the necktie and secure to the front backing plate.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
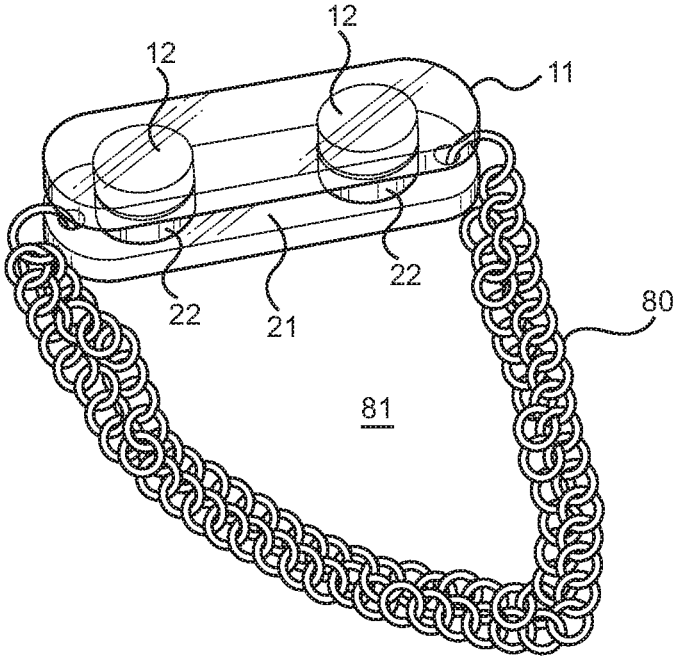
FIG. 1 shows a perspective view of an embodiment of the necktie retainer device of the present invention.

Reference is made herein to the attached drawings. Like reference numerals are used throughout the drawings to depict like or similar elements of the necktie retainer device of the present invention. For the purposes of presenting a brief and clear description of the present invention, the preferred embodiment will be discussed as used for securing a necktie to the shirt of a wearer, and optionally providing a fashionable necktie accessory. The figures are intended for representative purposes only and should not be considered to be limiting in any respect.

Figure 2:
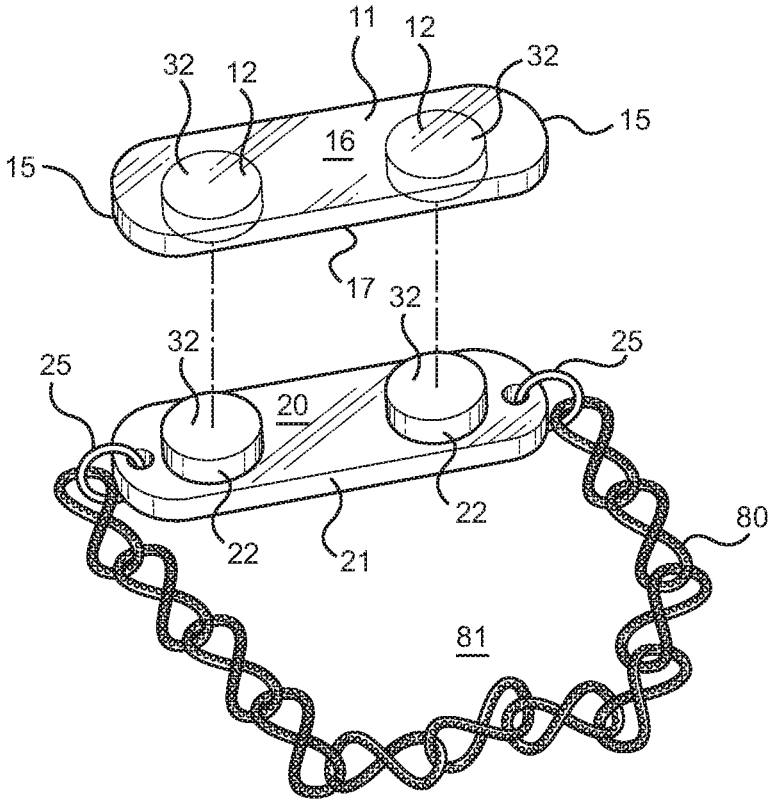
FIG. 2 shows an exploded view of an embodiment of the necktie retainer device of the present invention.
Figure 3:
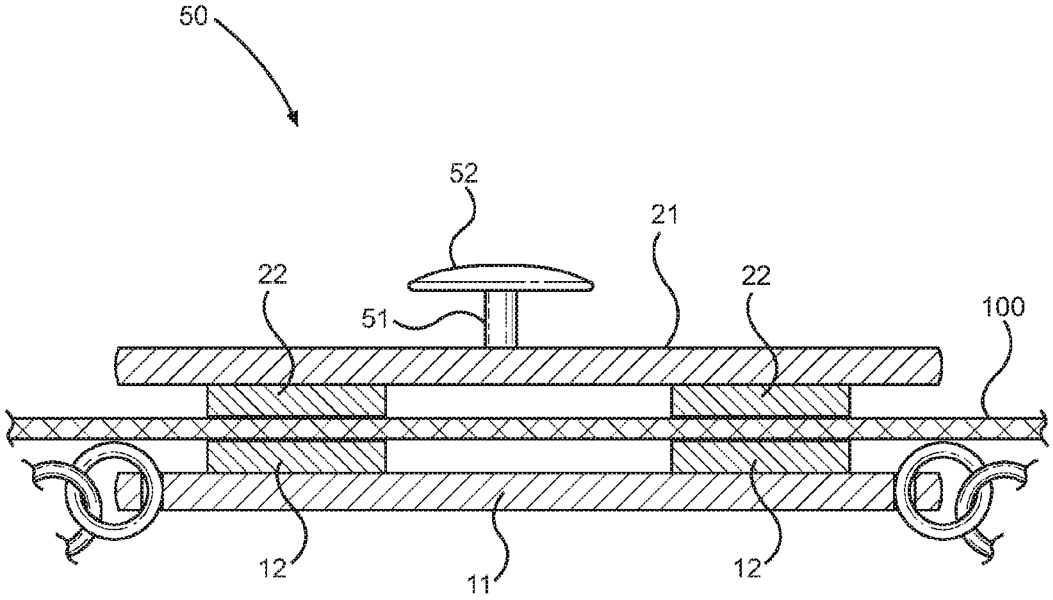
FIG. 3 shows an overhead view of the necktie retainer device of the present invention, sandwiching a garment surface between the backing plates.

Referring now to FIGS. 1 and 2, there are shown views of the necktie retainer device of the present invention. The necktie retainer device is one that is adapted to secure a necktie to the dress shirt of a wearer without piercing the shirt. In particular, the retainer device comprises a rear backing plate 11 and a front backing plate 21 that are adapted to align with one another and magnetically secure together. The rear backing plate 21 is adapted to be positioned along the inside of a wearer's shirt, while the front backing plate 21 is positioned between the outside surface of the shirt and the backside of a neck tie. Extending from the front backing plate 21 is a necktie retainer article, which may comprise one of several different necktie retainer assemblies that maintain the necktie against the front backing plate 21.

In one embodiment, the front backing plate 21 has a rear surface 26 with at least one magnet 22 thereon and the rear backing plate 11 has a front surface 17 with at least one magnet 12 thereon. The magnets 12 of the rear backing plate 11 each have an exposed surface with a first polarity. Likewise, the magnets 22 of the front backing plate 21 have an exposed surface that is adapted to align with the magnets 12 of the rear backing plate 11 and have a second polarity. The first polarity and second polarity are opposite, whereby the magnets 12 of the rear backing plate 11 are attracted to the magnets 22 of the front backing plate 21 when the backing plates are brought together and the magnets are aligned. In this embodiment, both backing plates include magnets, whereby the magnets are arranged to align when the backing plates are aligned, and furthermore are adapted to be attracted to one another when aligned.

In another embodiment, at least one magnetic connector 32 is provided between the front and rear backing plates. The magnetic connector 32 comprises one magnet and a material that is attracted to the magnet. This may comprise another magnet, or alternatively a ferromagnetic material. In one embodiment, the rear backing plate 11 has a front surface 17 with at least one magnetic connector 32 thereon. The front backing plate 21 has a rear surface 26 with at least one magnetic connector thereon 32. The magnetic connectors 32 of the rear backing plate 11 and the front backing plate 21 are aligned with one another, whereby each magnetic connector 32 forms a complimentary pair of connectors comprising a magnet and a ferromagnetic material. In this manner, each connector includes one magnet and one ferromagnetic material rather than pairs of magnets. The backing plates may comprise one or more magnetic connector pairs, and one or more sets of complimentary magnets, depending on design.

Referring to FIGS. 1-4, additional views and embodiments are presented. Each of the backing plates 11, 21 comprises a length of material with one or more magnetic connectors 32 thereon. The rear backing plate 11 comprises a rear surface 16, a front surface 17, and a pair of ends 15. Each of the sets of connectors 32 comprise at least one magnet 22, 12, whereby the connectors 32 are aligned between the backing plates when the backing plates are aligned. Extending from front backing plate 21 is a necktie retainer article 80. The necktie retainer article 80 is adapted to secure two segments of a necktie and retain the two segments against the front backing plate 21. The at least one magnet of the rear backing plate 11 and the at least one magnet of the front backing plate 21 each having a magnetic field of sufficient magnitude to secure the magnetic connectors of the front 21 and rear backing plates 11 together with a dress shirt 100 or similarly garment layer disposed therebetween.

When in a working state, the rear backing plate 11 is positioned along the inside of a shirt layer 100, while the front backing plate 21 is disposed along the outside of the shirt layer 100. The magnetic connectors 12, 22, are attracted together across the shirt layer 100. The attraction is sufficient to pinch the shirt layer 100 therebetween, while friction between the magnetic connectors and the shirt layer 100 prevent movement of the backing plates once connected by the connectors. Therefore, the two backing plates remain stationary on the dress shirt, and the user can secure the necktie using the necktie retainer article extending from the front backing plate 11.

The necktie retainer article may comprise one of several necktie retainers. In one embodiment, the necktie retainer article further comprises a chain 80. The chain 80 has a first end connected to a first end 25 of the front backing plate 21, and a second end connected to an opposite (second) end 25 of the front backing plate 21. The chain 80 and the front backing plate 21 form an enclosed loop 81 adapted to receive a necktie therethrough. The chain 80 may be decorative and have different designs or patterns, falling within the scope of providing a loose, close-loop retainer element.

Figure 4:
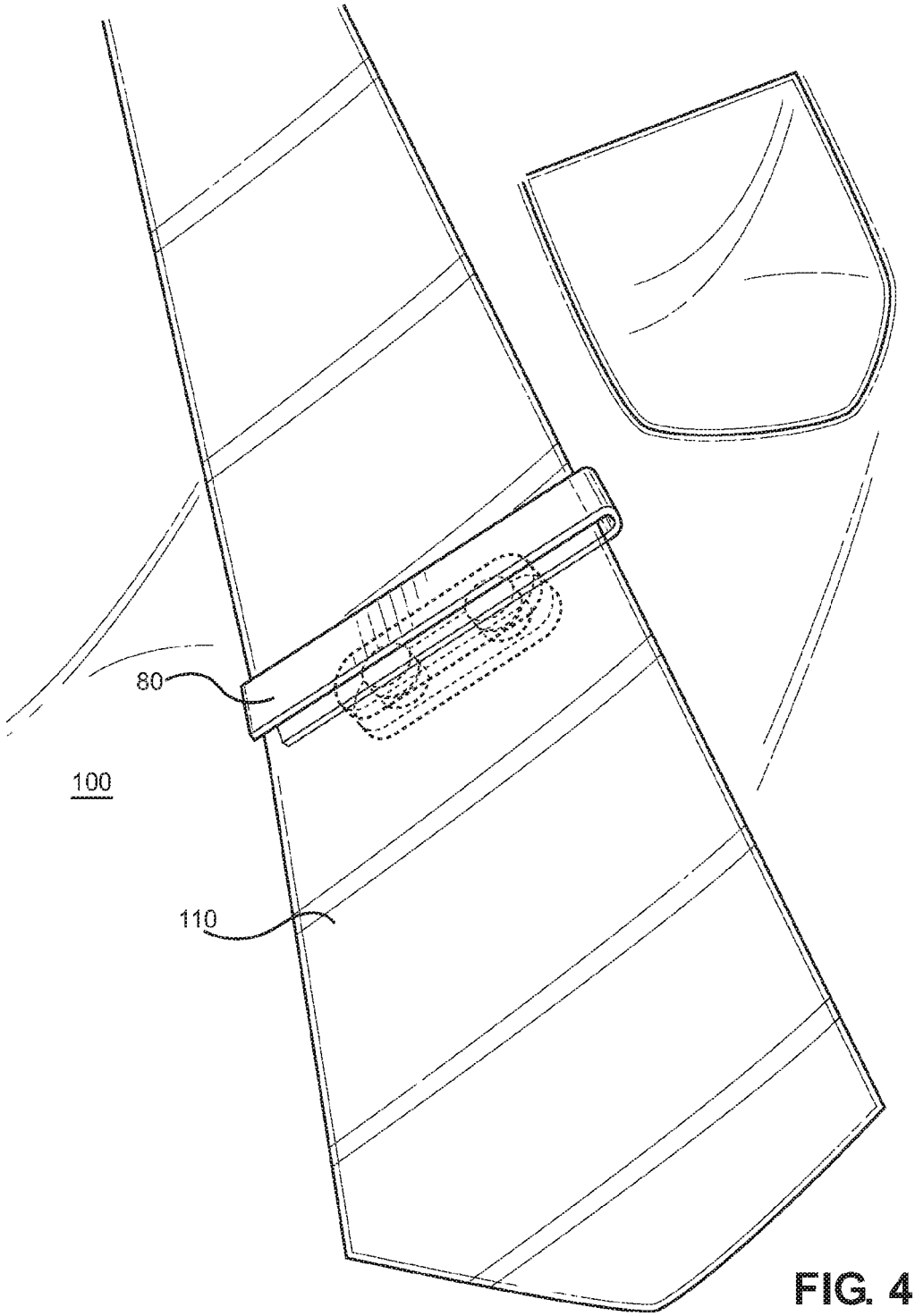
FIG. 4 shows another view of the necktie retainer device of the present invention in a working state.

In another embodiment, the necktie retainer article further comprises a necktie bar (FIG. 4). The necktie bar has a first end connected to a first end 25 of the front backing plate 21 and a second end that is separated from a second end of the front backing plate 21 to form a gap therebetween. The necktie bar and the front backing plate 21 form a partially enclosed interior adapted to retain a necktie 110 therein and receive the necktie 110 through the gap between the second end of the necktie bar and the second end of the front backing plate 21.

In another embodiment, the necktie retainer article further comprises a necktie pin 50 (FIG. 3) adapted to pierce the necktie and secure to the front backing plate 21. The necktie pin 50 includes a pin 51 and a pin cap 52. The pin 51 is adapted to pierce through a necktie, while the cap secures over the distal end of the pin 51 once inserted through the tie. The pin cap 52 may comprise a decorative or ornamental appearance, as can the necktie bar and necktie chain.

The shape and design of the backing plates may further take on different shapes and designs. In one embodiment, the least one magnet 12 of the rear backing plate 11 further comprises two magnets 12, and the least one magnet 22 of the front backing plate 21 further comprises two magnets 22. The front backing plate 21 and the rear backing plate 11 each further comprise planar surfaces such that each can be aligned with one another. When aligned, the two magnets 22 of the front backing plate 21 are aligned with the two magnets 12 of the rear backing plate 11.

Overall, the present invention provides a unique device for holding neckties in place while donned. A magnetic connector maintains the necktie in place and against the wearer's shirt without the need to pierce the shirt. Furthermore, the present invention allows for a necktie to remain in place and be accompanied by adornments or ornamental features disposed on the retainer article. Overall, the present invention provides a fashionable accompaniment to any necktie and dress shirt arrangement.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A necktie retainer, comprising:

a rear backing plate;

a front backing plate;

the rear backing plate having a front surface with at least one magnet thereon;

the front backing plate having a rear surface with at least one magnet thereon;

the at least one magnet of the rear backing plate having an exposed surface with a first polarity;

the at least one magnet of the front backing plate having an exposed surface with a second polarity;

the first polarity and second polarity being opposite such that the at least one magnet of the rear backing plate is configured to be attracted to the at least one magnet of the front backing plate;

the front backing plate comprising a necktie retainer article thereon;

the necktie retainer article being adapted to secure two segments of a necktie and retain the two segments against the front backing plate;

the at least one magnet of the rear backing plate and the at least one magnet of the front backing plate each having a magnetic field of sufficient magnitude to secure the at least one magnet of the rear backing plate to the at least one magnet of the front backing plate with a dress shirt material layer therebetween;

the least one magnet of the rear backing plate further comprises two magnets;

wherein the least one magnet of the front backing plate further comprises two magnets;

the two magnets of the front backing plate being aligned with the two magnets of the rear backing plate when the front backing plate is aligned with the rear backing plate.

2. The necktie retainer of claim 1, wherein the front backing plate and the rear backing plate each further comprise planar surfaces.

3. The necktie retainer of claim 1, wherein:

the necktie retainer article comprises a necktie bar;

the necktie bar having a first end connected to a first end of the front backing plate and a second end that is separated from a second end of the front backing plate to form a gap therebetween;

the necktie bar and the front backing plate forming a partially enclosed interior adapted to retain a necktie therein and receive the necktie through the gap between the second end of the necktie bar and the second end of the front backing plate.

4. The necktie retainer of claim 1, wherein:

the necktie retainer article comprises a necktie pin adapted to pierce the necktie and secure to the front backing plate.

5. A necktie retainer, comprising:

a rear backing plate;

a front backing plate;

the rear backing plate having a front surface with at least one magnet thereon;

the front backing plate having a rear surface with at least one magnet thereon;

the at least one magnet of the rear backing plate having an exposed surface with a first polarity;

the at least one magnet of the front backing plate having an exposed surface with a second polarity;

the first polarity and second polarity being opposite such that the at least one magnet of the rear backing plate is configured to be attracted to the at least one magnet of the front backing plate;

the front backing plate comprising a necktie retainer article thereon;

the necktie retainer article being adapted to secure two segments of a necktie and retain the two segments against the front backing plate;

the at least one magnet of the rear backing plate and the at least one magnet of the front backing plate each having a magnetic field of sufficient magnitude to secure the at least one magnet of the rear backing plate to the at least one magnet of the front backing plate with a dress shirt material layer therebetween;

the necktie retainer article comprises a chain;

the chain having a first end connected to a first end of the front backing plate;

the chain having a second end connected to a second end of the front backing plate;

the chain and the front backing plate forming an enclosed loop adapted to receive a necktie therethrough.

6. A necktie retainer, comprising:

a rear backing plate;

a front backing plate;

the rear backing plate having a front surface with at least one magnetic connector thereon;

the front backing plate having a rear surface with at least one magnetic connector thereon;

wherein the magnetic connectors of the rear backing plate and the front backing plate are aligned with one another;

wherein the magnetic connectors form a complimentary pair comprising a magnet and a ferromagnetic material;

the front backing plate further comprising a necktie retainer article thereon;

the necktie retainer article being adapted to secure two segments of a necktie and retain the two segments against the front backing plate; and wherein the magnet of the at least one magnetic connector has a magnetic field of sufficient magnitude to secure the magnet to the ferromagnetic material with a dress shirt material layer therebetween;

the necktie retainer article comprises a chain;

the chain having a first end connected to a first end of the front backing plate;

the chain having a second end connected to a second end of the front backing plate;

the chain and the front backing plate forming an enclosed loop adapted to receive a necktie therethrough.

7. The necktie retainer of claim 6, wherein the front backing plate and the rear backing plate each further comprise planar surfaces.

8. The necktie retainer of claim 6, wherein:

the necktie retainer article comprises a necktie bar;

the necktie bar having a first end connected to a first end of the front backing plate and a second end that is separated from a second end of the front backing plate to form a gap therebetween;

the necktie bar and the front backing plate forming a partially enclosed interior adapted to retain a necktie therein and receive the necktie through the gap between the second end of the necktie bar and the second end of the front backing plate.

9. The necktie retainer of claim 6, wherein:

the necktie retainer article comprises a necktie pin adapted to pierce the necktie and secure to the front backing plate.

* * * * *